US009967950B2

(12) United States Patent
Battaglia

(10) Patent No.: US 9,967,950 B2
(45) Date of Patent: May 8, 2018

(54) PRE-CHARGE LIGHTING CONTROL CIRCUIT

(71) Applicant: Phoseon Technology, Inc., Hillsboro, OR (US)

(72) Inventor: Salvatore T. Battaglia, Vancouver, WA (US)

(73) Assignee: Phoseon Technology, Inc., Hillsboro, OR (US)

( * ) Notice: Subject to any disclaimer, the term of this patent is extended or adjusted under 35 U.S.C. 154(b) by 0 days. days.

(21) Appl. No.: 15/710,687

(22) Filed: Sep. 20, 2017

(65) Prior Publication Data

US 2018/0092185 A1 Mar. 29, 2018

Related U.S. Application Data

(60) Provisional application No. 62/398,794, filed on Sep. 23, 2016.

(51) Int. Cl.
*H05B 37/02* (2006.01)

(52) U.S. Cl.
CPC ..... *H05B 37/02* (2013.01)

(58) Field of Classification Search
CPC ..... H05B 37/02; H05B 37/0227; H05B 37/0272; H05B 33/08; H05B 33/0818; H05B 33/0842; H05B 33/0881
USPC ..... 315/152–159, 185 R, 209 R, 210, 225, 315/226, 291, 307, 308, 362
See application file for complete search history.

(56) References Cited

U.S. PATENT DOCUMENTS

| | | | | |
|---|---|---|---|---|
| 8,188,734 | B1 | 5/2012 | Abuelma'atti et al. | |
| 8,427,125 | B2 | 4/2013 | Brinkman | |
| 2006/0158392 | A1* | 7/2006 | Liao | G09G 3/3216 345/76 |
| 2009/0167267 | A1 | 7/2009 | Dwarakanath et al. | |
| 2010/0134040 | A1 | 6/2010 | Elder | |
| 2015/0340950 | A1 | 11/2015 | Wibben et al. | |
| 2016/0100467 | A1 | 4/2016 | Battaglia | |

OTHER PUBLICATIONS

ISA Korean Intellectual Property Office, International Search Report and Written Opinion Issued in Application No. PCT/US2017/052565, dated Jan. 9, 2018, WIPO, 14 pages.

* cited by examiner

*Primary Examiner* — Jimmy Vu
(74) *Attorney, Agent, or Firm* — McCoy Russell LLP

(57) ABSTRACT

A system and method for operating one or more light emitting devices is disclosed. In one example, an analog circuit outputs a voltage pulse to drive a voltage regulator in a way that may provide more consistent light intensity from the one or more light emitting devices over a range of requested lighting intensity levels.

20 Claims, 5 Drawing Sheets

PRE-CHARGE LIGHTING CONTROL CIRCUIT

CROSS REFERENCE TO RELATED APPLICATIONS

The present application claims priority to U.S. Provisional Application No. 62/398,794, entitled "PRE-CHARGE LIGHTING CONTROL CIRCUIT", filed on Sep. 23, 2016, the entire contents of which are hereby incorporated by reference for all purposes.

BACKGROUND/SUMMARY

Solid-state lighting devices may be operated at various lighting intensity levels to provide various levels of illumination. In some cases, lighting device output has an effect on curing time of a device being manufactured or other process variable. Therefore, it may be desirable to provide a consistent known level of light intensity to reduce product variation. However, power is often supplied to a lighting array via a voltage regulator. The initial output of the voltage regulator may be inconsistent between different levels of illumination from the lighting array. For example, if 40% of available voltage regular output is requested for a desired level of light intensity, it may take the voltage regulator 15 ms to output voltage sufficient to provide the desired level of light intensity. However, if 100% of available voltage regulator output is requested for a desired level of light intensity, it may take the voltage regulator 2 ms to output voltage sufficient to provide the desired level of light intensity. The response time lag may be attributed to charging of resistor/capacitor networks within the voltage regulator. It may be desirable for output of the voltage regulator to respond in a way that provides more consistent starting times between the various levels of requested lighting intensity so that output from the lighting array may be more consistent.

The inventor herein has recognized the above-mentioned disadvantages and has developed a system for operating one or more light emitting devices, comprising: an array of solid state lighting devices; a voltage regulator including a voltage regulator input, the voltage regulator electrically coupled to the array of solid state lighting devices; and an analog pre-charge circuit having a pre-charge circuit output, the pre-charge circuit output electrically coupled to the voltage regulator input, the analog pre-charge circuit including an pre-charge circuit input, the pre-charge circuit input electrically coupled to the array of solid state lighting devices, the analog pre-charge circuit including a timing circuit, the analog pre-charge circuit including a first capacitor and a first resistor electrically coupled to the timing circuit.

By controlling providing an input to a voltage regulator from an analog pre-charge circuit, it may be possible to more precisely control light intensity of a lighting array during lighting array power-up conditions. The analog pre-charge circuit may output a voltage pulse having a duration that is controlled as a function of time or a voltage that develops at solid state lighting devices. The analog pre-charge circuit may output a voltage of a predetermined duration when a lower level of light intensity is requested. The voltage pulse of the predetermined duration acts to rapidly charge resistor/capacitor networks within the voltage regulator so that the required light intensity may be provided. The analog pre-charge circuit may output a voltage pulse with a duration that is limited by a voltage that develops at the solid state lighting devices for higher levels of requested light intensity. By limiting the analog pre-charge circuit output voltage in response to a voltage at the lighting devices, voltage regulator output may be controlled to conserve energy and reduce the possibility of exceeding the desired light intensity level.

The present description may provide several advantages. In particular, the approach may improve lighting system light intensity control. Further, the approach may provide improve power consumption. Further still, the approach may be provided without need of a sophisticated digital controller.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
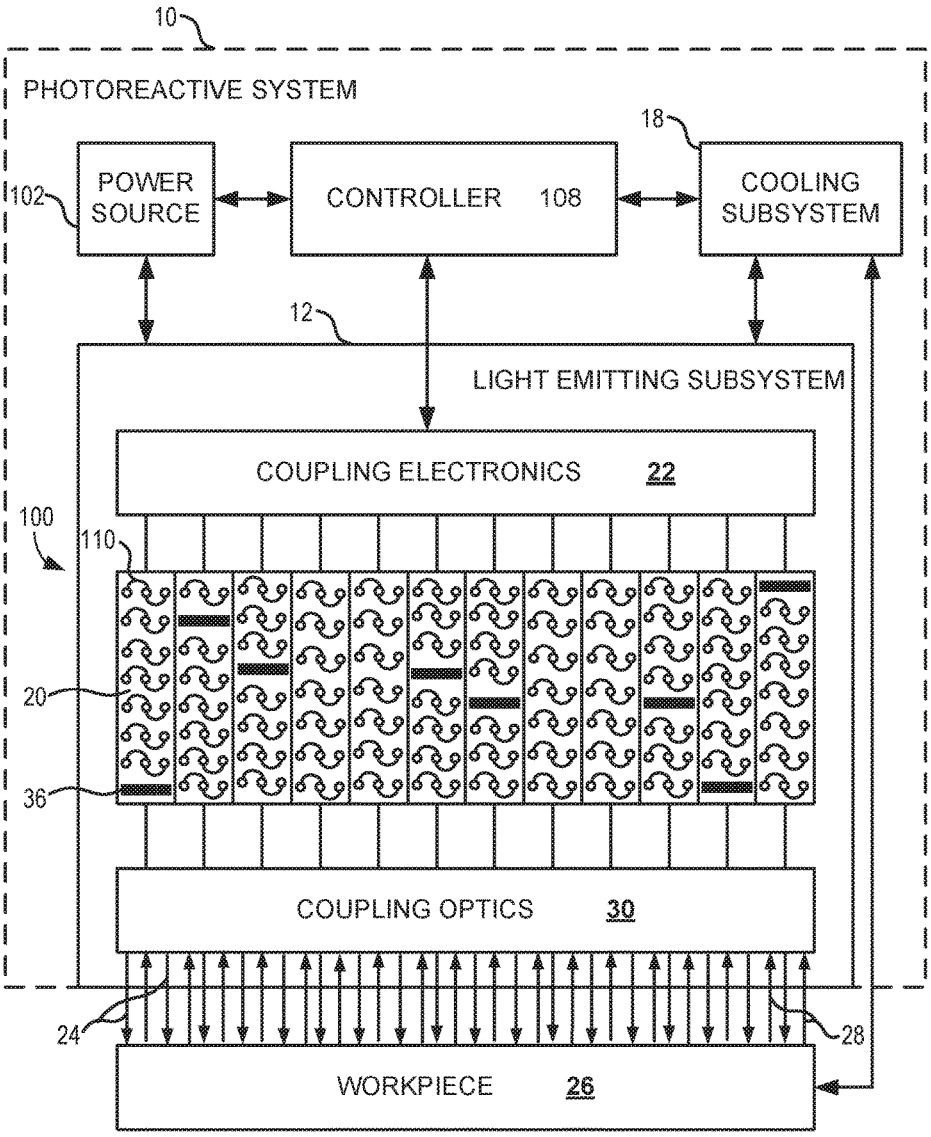
FIG. 1 shows a schematic depiction of a lighting system.
Figure 2:
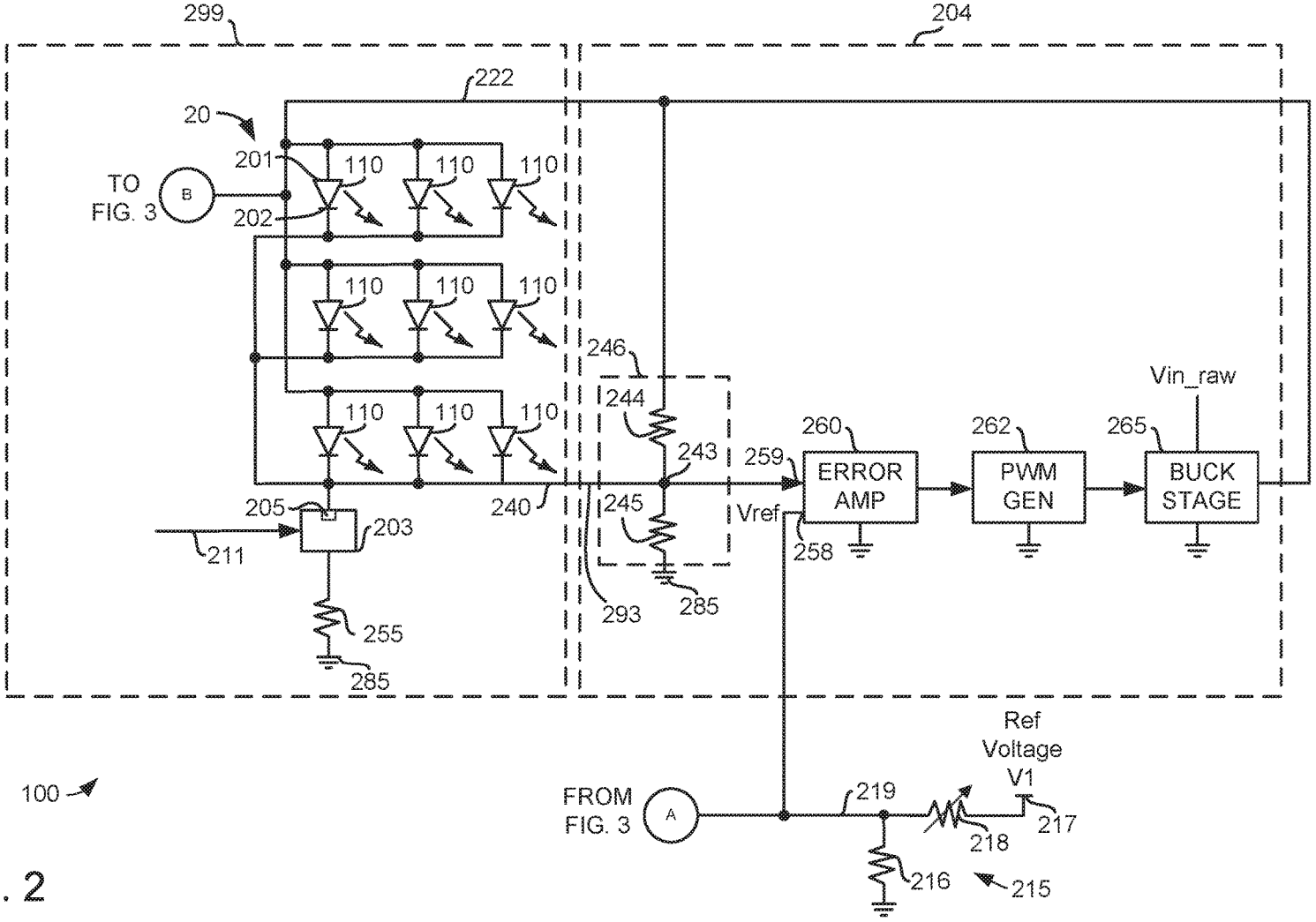
FIG. 2 shows a schematic of an example lighting array voltage regulator.
Figure 3:
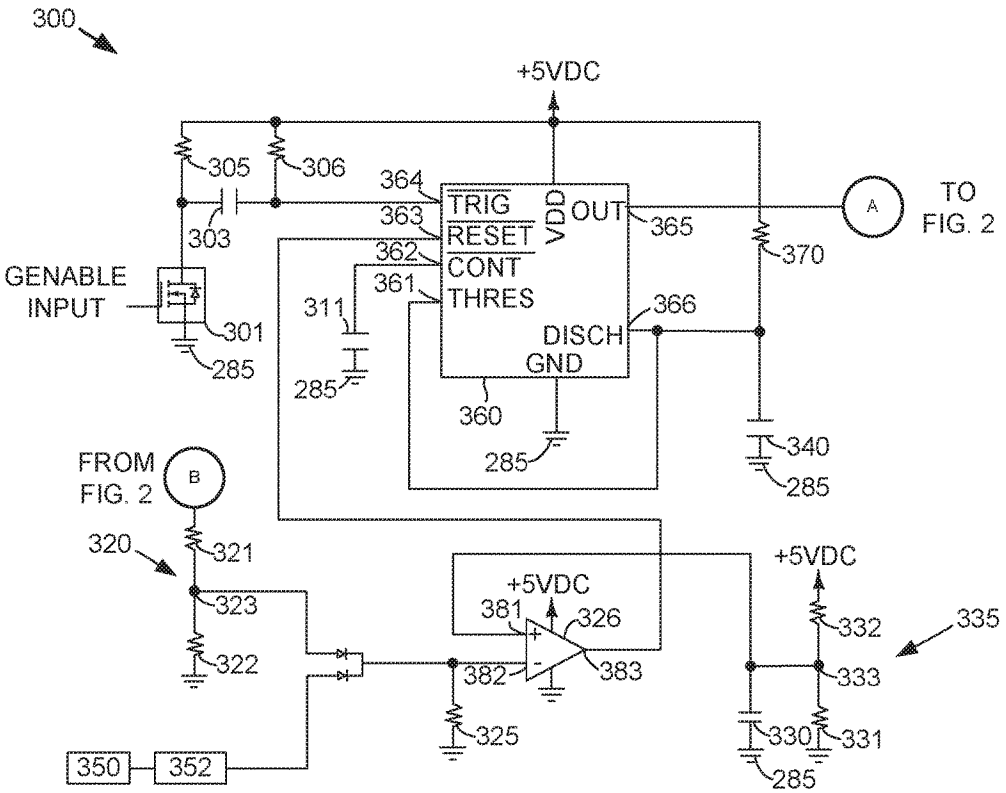
FIG. 3 shows an example analog pre-charge circuit.

The present description is related to a lighting system with regulated current. FIG. 1 shows one example lighting system in which regulated current control is provided. The lighting current control may be provided according to example circuits as shown in FIGS. 2 and 3. However, alternative circuits that provide the described function or that operate similar to the circuits shown are also included within the scope of the description. The lighting system may provide the prophetic sequence shown in FIG. 4. The circuitry may operate according to the method of FIG. 5. Lines representing electrical interconnections shown between components in the various electrical diagrams represent current paths between the illustrate devices.

Referring now to FIG. 1, a block diagram of a photoreactive system 10 in accordance with the system and method described herein is shown. In this example, the photoreactive system 10 comprises a lighting subsystem 100, a controller 108, a power source 102 and a cooling subsystem 18.

The lighting subsystem 100 may comprise a plurality of light emitting devices 110. Light emitting devices 110 may be LED devices, for example. Selected of the plurality of light emitting devices 110 are implemented to provide radiant output 24. The radiant output 24 is directed to a work piece 26. Returned radiation 28 may be directed back to the lighting subsystem 100 from the work piece 26 (e.g., via reflection of the radiant output 24).

The radiant output 24 may be directed to the work piece 26 via coupling optics 30. The coupling optics 30, if used, may be variously implemented. As an example, the coupling optics may include one or more layers, materials or other structure interposed between the light emitting devices 110 providing radiant output 24 and the work piece 26. As an example, the coupling optics 30 may include a micro-lens array to enhance collection, condensing, collimation or otherwise the quality or effective quantity of the radiant output 24. As another example, the coupling optics 30 may include a micro-reflector array. In employing such micro-reflector array, each semiconductor device providing radiant output 24 may be disposed in a respective micro-reflector, on a one-to-one basis.

Each of the layers, materials or other structure may have a selected index of refraction. By properly selecting each index of refraction, reflection at interfaces between layers, materials and other structure in the path of the radiant output 24 (and/or returned radiation 28) may be selectively controlled. As an example, by controlling differences in such indexes of refraction at a selected interface disposed between the semiconductor devices to the work piece 26, reflection at that interface may be reduced, eliminated, or minimized, so as to enhance the transmission of radiant output at that interface for ultimate delivery to the work piece 26.

The coupling optics 30 may be employed for various purposes. Example purposes include, among others, to protect the light emitting devices 110, to retain cooling fluid associated with the cooling subsystem 18, to collect, condense and/or collimate the radiant output 24, to collect, direct or reject returned radiation 28, or for other purposes, alone or in combination. As a further example, the photoreactive system 10 may employ coupling optics 30 so as to enhance the effective quality or quantity of the radiant output 24, particularly as delivered to the work piece 26.

Selected of the plurality of light emitting devices 110 may be coupled to the controller 108 via coupling electronics 22, so as to provide data to the controller 108. As described further below, the controller 108 may also be implemented to control such data-providing semiconductor devices, e.g., via the coupling electronics 22.

The controller 108 preferably is also connected to, and is implemented to control, each of the power source 102 and the cooling subsystem 18. Moreover, the controller 108 may receive data from power source 102 and cooling subsystem 18.

The data received by the controller 108 from one or more of the power source 102, the cooling subsystem 18, the lighting subsystem 100 may be of various types. As an example, the data may be representative of one or more characteristics associated with coupled semiconductor devices 110, respectively. As another example, the data may be representative of one or more characteristics associated with the respective component 12, 102, 18 providing the data. As still another example, the data may be representative of one or more characteristics associated with the work piece 26 (e.g., representative of the radiant output energy or spectral component(s) directed to the work piece). Moreover, the data may be representative of some combination of these characteristics.

The controller 108, in receipt of any such data, may be implemented to respond to that data. For example, responsive to such data from any such component, the controller 108 may be implemented to control one or more of the power source 102, cooling subsystem 18, and lighting subsystem 100 (including one or more such coupled semiconductor devices). As an example, responsive to data from the lighting subsystem indicating that the light energy is insufficient at one or more points associated with the work piece, the controller 108 may be implemented to either (a) increase the power source's supply of current and/or voltage to one or more of the semiconductor devices 110, (b) increase cooling of the lighting subsystem via the cooling subsystem 18 (i.e., certain light emitting devices, if cooled, provide greater radiant output), (c) increase the time during which the power is supplied to such devices, or (d) a combination of the above.

Individual semiconductor devices 110 (e.g., LED devices) of the lighting subsystem 100 may be controlled independently by controller 108. For example, controller 108 may control a first group of one or more individual LED devices to emit light of a first intensity, wavelength, and the like, while controlling a second group of one or more individual LED devices to emit light of a different intensity, wavelength, and the like. The first group of one or more individual LED devices may be within the same array of semiconductor devices 110, or may be from more than one array of semiconductor devices 110. Arrays of semiconductor devices 110 may also be controlled independently by controller 108 from other arrays of semiconductor devices 110 in lighting subsystem 100 by controller 108. For example, the semiconductor devices of a first array may be controlled to emit light of a first intensity, wavelength, and the like, while those of a second array may be controlled to emit light of a second intensity, wavelength, and the like.

As a further example, under a first set of conditions (e.g. for a specific work piece, photoreaction, and/or set of operating conditions) controller 108 may operate photoreactive system 10 to implement a first control strategy, whereas under a second set of conditions (e.g. for a specific work piece, photoreaction, and/or set of operating conditions) controller 108 may operate photoreactive system 10 to implement a second control strategy. As described above, the first control strategy may include operating a first group of one or more individual semiconductor devices (e.g., LED devices) to emit light of a first intensity, wavelength, and the like, while the second control strategy may include operating a second group of one or more individual LED devices to emit light of a second intensity, wavelength, and the like. The first group of LED devices may be the same group of LED devices as the second group, and may span one or more arrays of LED devices, or may be a different group of LED devices from the second group, and the different group of LED devices may include a subset of one or more LED devices from the second group.

The cooling subsystem 18 is implemented to manage the thermal behavior of the lighting subsystem 100. For example, generally, the cooling subsystem 18 provides for cooling of such subsystem 12 and, more specifically, the semiconductor devices 110. The cooling subsystem 18 may also be implemented to cool the work piece 26 and/or the space between the piece 26 and the photoreactive system 10 (e.g., particularly, the lighting subsystem 100). For example, cooling subsystem 18 may be an air or other fluid (e.g., water) cooling system.

The photoreactive system 10 may be used for various applications. Examples include, without limitation, curing applications ranging from ink printing to the fabrication of DVDs and lithography. Generally, the applications in which the photoreactive system 10 is employed have associated parameters. That is, an application may include associated operating parameters as follows: provision of one or more levels of radiant power, at one or more wavelengths, applied over one or more periods of time. In order to properly accomplish the photoreaction associated with the application, optical power may need to be delivered at or near the work piece at or above a one or more predetermined levels of one or a plurality of these parameters (and/or for a certain time, times or range of times).

In order to follow an intended application's parameters, the semiconductor devices 110 providing radiant output 24 may be operated in accordance with various characteristics associated with the application's parameters, e.g., temperature, spectral distribution and radiant power. At the same time, the semiconductor devices 110 may have certain operating specifications, which may be are associated with the semiconductor devices' fabrication and, among other things, may be followed in order to preclude destruction and/or forestall degradation of the devices. Other components of the photoreactive system 10 may also have associated operating specifications. These specifications may include ranges (e.g., maximum and minimum) for operating temperatures and applied, electrical power, among other parameter specifications.

Accordingly, the photoreactive system 10 supports monitoring of the application's parameters. In addition, the photoreactive system 10 may provide for monitoring of semiconductor devices 110, including their respective characteristics and specifications. Moreover, the photoreactive system 10 may also provide for monitoring of selected other components of the photoreactive system 10, including their respective characteristics and specifications.

Providing such monitoring may enable verification of the system's proper operation so that operation of photoreactive system 10 may be reliably evaluated. For example, the system 10 may be operating in a undesirable way with respect to one or more of the application's parameters (e.g., temperature, radiant power, etc.), any components characteristics associated with such parameters and/or any component's respective operating specifications. The provision of monitoring may be responsive and carried out in accordance with the data received by controller 108 by one or more of the system's components.

Monitoring may also support control of the system's operation. For example, a control strategy may be implemented via the controller 108 receiving and being responsive to data from one or more system components. This control, as described above, may be implemented directly (i.e., by controlling a component through control signals directed to the component, based on data respecting that components operation) or indirectly (i.e., by controlling a component's operation through control signals directed to adjust operation of other components). As an example, a semiconductor device's radiant output may be adjusted indirectly through control signals directed to the power source 102 that adjust power applied to the lighting subsystem 100 and/or through control signals directed to the cooling subsystem 18 that adjust cooling applied to the lighting subsystem 100.

Control strategies may be employed to enable and/or enhance the system's proper operation and/or performance of the application. In a more specific example, control may also be employed to enable and/or enhance balance between the array's radiant output and its operating temperature, so as, e.g., to preclude heating the semiconductor devices 110 or array of semiconductor devices 110 beyond their specifications while also directing radiant energy to the work piece 26 sufficient to properly complete the photoreaction(s) of the application.

In some applications, high radiant power may be delivered to the work piece 26. Accordingly, the subsystem 12 may be implemented using an array of light emitting semiconductor devices 110. For example, the subsystem 12 may be implemented using a high-density, light emitting diode (LED) array. Although LED arrays may be used and are described in detail herein, it is understood that the semiconductor devices 110, and array(s) of same, may be implemented using other light emitting technologies without departing from the principles of the description, examples of other light emitting technologies include, without limitation, organic LEDs, laser diodes, other semiconductor lasers.

The plurality of semiconductor devices 110 may be provided in the form of an array 20, or an array of arrays. The array 20 may be implemented so that one or more, or most of the semiconductor devices 110 are configured to provide radiant output. At the same time, however, one or more of the array's semiconductor devices 110 are implemented so as to provide for monitoring selected of the array's characteristics. The monitoring devices 36 may be selected from among the devices in the array 20 and, for example, may have the same structure as the other, emitting devices. For example, the difference between emitting and monitoring may be determined by the coupling electronics 22 associated with the particular semiconductor device (e.g., in a basic form, an LED array may have monitoring LEDs where the coupling electronics provides a reverse current, and emitting LEDs where the coupling electronics provides a forward current).

Furthermore, based on coupling electronics, selected of the semiconductor devices in the array 20 may be either/both multifunction devices and/or multimode devices, where (a) multifunction devices are capable of detecting more than one characteristic (e.g., either radiant output, temperature, magnetic fields, vibration, pressure, acceleration, and other mechanical forces or deformations) and may be switched among these detection functions in accordance with the application parameters or other determinative factors and (b) multimode devices are capable of emission, detection and some other mode (e.g., off) and are switched among modes in accordance with the application parameters or other determinative factors.

Referring to FIG. 2, a schematic of a first lighting system circuit that may supply varying amounts of current is shown. Lighting system 100 includes one or more light emitting devices 110. In this example, light emitting devices 110 are light emitting diodes (LEDs). Each LED 110 includes an anode 201 and a cathode 202. Switching power source 102 shown in FIG. 1 supplies 48V DC power to voltage regulator 204. Voltage regulator 204 supplies DC power to the anodes 201 of LEDs 110 via conductor or path 222. Voltage regulator 204 is also electrically coupled to cathodes 202 of LEDs 110 via conductor or path 240. Voltage regulator 204 is shown referenced to ground 285 and may be a buck regulator in one example. Voltage regulator 204 may be part of controller 108. Voltage regulator 204 supplies an adjustable voltage to LEDs 110.

Device 230, which may be a variable resistor in the form of a field-effect transistor (FET), receives an intensity signal voltage from a user input such as a potentiometer or other device (not shown). Alternatively, the variable resistor may simply be commanded to provide a low resistance to activate LEDs 110. While the present example describes the variable resistor as an FET, one must note that the circuit may employ other forms of variable resistors.

In this example, at least one element of array 20 includes solid-state light-emitting elements such as light-emitting diodes (LEDs) or laser diodes produce light. The elements may be configured as a single array on a substrate, multiple arrays on a substrate, several arrays either single or multiple on several substrates connected together, etc. In one example, the array of light-emitting elements may consist of a Silicon Light Matrix™ (SLM) manufactured by Phoseon Technology, Inc.

The circuit shown in FIG. 2 is a closed loop current control circuit. In the closed loop circuit, variable resistor 203 may receive an intensity voltage control signal via conductor or path 211. Voltage between variable resistor 203 and array 20 is controlled to a desired voltage as determined by voltage regulator 204. The desired voltage value may be supplied by voltage divider 215, which includes potentiometer 218 and resistor 216. Voltage divider 215 receives a voltage from reference voltage V1 at 217. Voltage regulator 204 controls voltage signal 222 to a level that provides the desired voltage in a current path between array 20 and variable resistor 203. Variable resistor 203 controls current flow from array 20 to current sense resistor 255. The desired voltage may also be adjusted responsive to the type of lighting device, type of work piece, curing parameters, and various other operating conditions. An electrical current signal may be fed back along conductor or path 240 to voltage regulator 204.

In one example, where the voltage between variable resistor 203 and array 20 is adjusted to a constant voltage, current flow through array 20 and variable resistor 203 is adjusted via adjusting the resistance of variable resistor 203. Thus, a voltage signal carried along conductor 240 from the variable resistor 220 does not go to the array 20 in this example. Instead, the voltage feedback between array 20 and variable resistor 220 follows conductor 240 and goes to a voltage regulator 204. The voltage regulator 204 then outputs a voltage signal via conductor 222 to the array 20. Consequently, voltage regulator 204 adjusts its output voltage in response to a voltage downstream of array 20, and current flow through array 20 is adjusted via variable resistor 203. Conductor 240 allows electrical communication between the cathodes 202 of LEDs 110, input 205 (e.g., a drain of an N-channel MOSFET) of variable resistor 203, and voltage feedback input 293 of voltage regulator 204. Thus, the cathodes 202 of LEDs 110 an input side 205 of variable resistor 203 and voltage feedback input 293 are at the same voltage potential.

The variable resistor may take the form of an FET, a bipolar transistor, a digital potentiometer or any electrically controllable, current limiting device. The closed loop system operates such that an output voltage regulator 204 remains about 0.5 V above a voltage to operate array 20. The regulator output voltage adjusts voltage applied to array 20 and the variable resistor controls current flow through array 20 to a desired level. The present circuit may increase lighting system efficiency and reduce heat generated by the lighting system as compared to other approaches. In the example of FIG. 2, the variable resistor 203 typically produces a voltage drop in the range of 0.6V. However, the voltage drop at variable resistor 203 may be less or greater than 0.6V depending on the variable resistor's design.

Thus, the circuit shown in FIG. 2 provides voltage feedback to a voltage regulator to control the voltage drop across array 20. For example, since operation of array 20 results in a voltage drop across array 20, voltage output by voltage regulator 204 is the desired voltage between array 20 and variable resistor 203 plus the voltage drop across array 20. If the resistance of variable resistor 203 is increased to decrease current flow through array 20, the voltage regulator output is adjusted (e.g., decreased) to maintain the desired voltage between array 20 and variable resistor 203. On the other hand, if the resistance of variable resistor 203 is decreased to increase current flow through array 20, the voltage regulator output is adjusted (e.g., increased) to maintain the desired voltage between array 20 and variable resistor 203. In this way, the voltage across array 20 and current through array 20 may be simultaneously adjusted to provide a desired light intensity output from array 20. In this example, current flow through array 20 is adjusted via a device (e.g., variable resistor 203) located or positioned downstream of array 20 (e.g., in the direction of current flow) and upstream of a ground reference 285.

In some examples, device 203 may be a switch and SLM 299 may include current sense resistor 255. However, device 203 and current sense resistor 255 may be included with voltage regulator 204 if desired. Voltage regulator 204 includes voltage divider 246 which is comprised of resistor 244 and resistor 245. Conductor 240 puts voltage divider 246 into electrical communication with cathodes 202 of LEDs 110 and device 203. Thus, the cathodes 202 of LEDs 110, an input side 205 (e.g., a drain of a N channel MOSFET) of device 203, and node 243 between resistors 244 and 245 are at a same voltage potential. Device or switch 203 may be operated in only open or closed states, and it does may not operate as a variable resistor having a resistance that can be linearly or proportionately adjusted. Further, in one example, switch 203 has a Vds of 0 V as compared to 0.6V Vds for variable resistor previously described.

The lighting system circuit of FIG. 2 also includes an error amplifier 260 receiving a voltage at input 259 that is indicative of current passing through array 20 via conductor 240 as measured by current sense resistor 255. Error amplifier 260 also receives a reference voltage from voltage divider 215 or another device via conductor 219. Output from error amplifier 260 is supplied to the input of pulse width modulator (PWM) 262. Output from PWM is supplied to buck stage regulator 265, and buck stage regulator 265 adjusts current supplied between a regulated DC power supply (e.g., 102 of FIG. 1) and array 20 from a position upstream of array 20.

In some examples, it may be desirable to adjust current supplied to array via a device located or upstream (e.g., in the direction of current flow) of array 20 instead of a position that is downstream of array 20 as is shown in FIG. 2. In the example lighting system of FIG. 2, a voltage the feedback signal supplied via conductor 240 goes directly to voltage regulator 204. An intensity voltage control signal supplied via conductor 219 from potentiometer 218 becomes a reference signal Vref, and it is applied to error amplifier 260.

The voltage regulator 204 directly controls the SLM current from a position upstream of array 20. In particular, resistor divider network 246 causes the buck regulator stage 265 to operate as a traditional buck regulator that monitors the output voltage of buck regulator stage 265 when the SLM is disabled by opening switch 203. The SLM may selectively receive an enable signal from conductor 211 which closes switch 203 and activates the SLM to provide light. Buck regulator stage 265 operates differently when a SLM enable signal is applied to conductor 211. Specifically, unlike more typical buck regulators, the buck regulator controls the load current, the current to the SLM and how much current is pushed through the SLM. In particular, when switch 203 is closed, current through array 20 is determined based on voltage that develops at node 243.

The voltage at node 243 is based on the current flowing through current sense resistor 255 and current flow in voltage divider 246. Thus, the voltage at node 243 is representative of current flowing through array 20. A voltage representing SLM current is compared to a reference voltage that represents a desired current flow through the SLM. If the SLM current is different from the desired SLM current, an error voltage develops at the output of error amplifier 260. The error voltage adjusts a duty cycle of PWM generator 262 and a pulse train from PWM generator 262 controls a charging time and a discharging time of a coil within buck stage 265. The coil charging and discharging timing adjusts an output voltage of voltage regulator 204. Since the resistance of array 20 is constant, current flow through array 20 may be adjusted via adjusting the voltage output from voltage regulator 204 and supplied to array 20. If additional array current is desired, voltage output from voltage regulator 204 is increased. If reduced array current is desired, voltage output from voltage regulator 204 is decreased.

Voltage regulator 204 may also receive a voltage pulse command via the pre-charge circuit shown in FIG. 3 into the second error amplifier input 258 as indicated at bubble A. Pre-charge circuit may receive an indication of LED forward voltage at the anodes 201 of LEDs 110 as indicated at bubble B. Those skilled in the art appreciate that the implementation of FIG. 2 presents merely one possible circuit in accordance with the examples discussed here.

Referring now to FIG. 3, an example pre-charge circuit 300 is shown. Output of analog pre-charge circuit is directed to voltage regulator 204 shown in FIG. 2 as indicated at bubble A. Pre-charge circuit 300 receives a voltage that is present at anodes of LEDs 110 shown in FIG. 2 as indicated at bubble B. Pre-charge circuit 300 may also receive a voltage from LEDs of additional SLMs including a second SLM 350 via a voltage divider network 352 which is similar to voltage network 320.

Pre-charge circuit 300 includes a timer circuit 360. In one example, the timer circuit is a Texas Instruments TLC555 integrated circuit. Timer circuit 360 includes inputs TRIG bar 364, RESET bar 363, CONT bar 362, THRES 361. Timer circuit also includes outputs OUT 365 and DISCH 366. As shown, timer circuit 360 is configured in a monostable mode to output a single voltage pulse at output 365. The voltage pulse has a rising edge (e.g., transition from a low voltage (ground) state to a high voltage state (5 volts) shortly after transistor 301 is activated and begins to conduct in response to a high level voltage being input at GENABLE INPUT to transistor 301. Activating transistor 301 pulls the TRIG bar input to near ground 285. Transistor 301 provides an electrical path to ground 285 when transistor 301 begins to conduct. Timer circuit 360 cuts off or truncates the voltage pulse in response to an amount of time passing since the voltage pulse output from timer circuit 360 transitioned from a low level to a high level or in response to a low level voltage input to the RESET bar input via operational amplifier 326. Timer circuit 360 does not output another voltage pulse until the GENABLE input transitions again from a low voltage level to a high voltage level. The values of first resistor 370 and first capacitor 340 determine the duration of the voltage pulse output from OUTPUT 365 if the RESET bar input does not transition from a high voltage to a low voltage before a predetermined amount of time based on the first resistor and first capacitor expires.

Third resistor 305, second resistor 306, and second capacitor 303 provide a debounce function for the signal input to TRIG bar input 364. Capacitor 311 is electrically coupled to the CONT bar input or control voltage input. Operational amplifier 326 is shown configured as a comparator. A voltage from voltage divider 335 is applied to non-inverting input 381 and a voltage from at voltage divider 320 is applied to inverting input 382. Initially the output 383 of amplifier 326 is a high level because of the voltage at node 333 being higher than the voltage at node 323. The output 383 of amplifier 326 transitions from the high voltage to a low voltage when voltage applied to inverting input 382 exceeds the voltage applied to non-inverting input 381. Resistor 325 pulls inverting input 382 to ground 285 when a low voltage is present at node 323. Voltage divider 320 is comprised of resistors 321 and 322. Voltage divider 335 is comprised of resistors 332 and 331. Capacitor 330 filters output of voltage divider 335.

Thus, the system of FIGS. 1-3 may provide a system for operating one or more light emitting devices, comprising: an array of solid state lighting devices; a voltage regulator including a voltage regulator input, the voltage regulator electrically coupled to the array of solid state lighting devices; and an analog pre-charge circuit having a pre-charge circuit output, the pre-charge circuit output electrically coupled to the voltage regulator input, the analog pre-charge circuit including an pre-charge circuit input, the pre-charge circuit input electrically coupled to the array of solid state lighting devices, the analog pre-charge circuit including a timing circuit, the analog pre-charge circuit including a first capacitor and a first resistor electrically coupled to the timing circuit.

In some examples, the system further comprises a second resistor, a third resistor, and a second capacitor electrically coupled to the timing circuit. The system further comprises a transistor electrically coupled to the second capacitor and the third resistor. The system includes where the timing circuit including a TRIG bar input, a RESET bar input, a CONT bar input, a THRES input, a DISCH output, and an OUT output. The system includes where first resistor and first capacitor are electrically coupled to the DISCH output, and where the DISCH output is electrically coupled to the THRES input. The system includes where the second resistor and the second capacitor are electrically coupled to the TRIG bar input. The system further comprises a third capacitor, where the third capacitor is electrically coupled to the CONT bar input. The system includes where the OUT output is electrically coupled to an input of the voltage regulator.

In some examples, the system of FIGS. 1-3 provides for a system for operating one or more light emitting devices, comprising: an array of solid state lighting devices; a voltage regulator including a voltage regulator input, the voltage regulator electrically coupled to the array of solid state lighting devices; and an analog pre-charge circuit having a pre-charge circuit output, the pre-charge circuit output electrically coupled to the voltage regulator input, the analog pre-charge circuit including a first pre-charge circuit input, the first pre-charge circuit input electrically coupled to the array of solid state lighting devices, the analog pre-charge circuit including a timing circuit, and the analog pre-charge circuit including a voltage comparator, the voltage comparator electrically coupled to the timing circuit and the first pre-charge circuit input.

The system further comprises a second pre-charge circuit input, the second pre-charge circuit input electrically coupled to a transistor. The system includes where the transistor is electrically coupled to a third resistor and a second capacitor, and where the second capacitor is electrically coupled to a second resistor and a TRIG bar input of the timing circuit. The system includes where the timing circuit including a TRIG bar input, a RESET bar input, a CONT bar input, a THRES input, a DISCH output, and an OUT output. The system includes where the analog pre-charge circuit includes a first capacitor and a first resistor electrically coupled to the timing circuit. The system further comprises a voltage divider electrically coupled to the voltage comparator.

Figure 4:
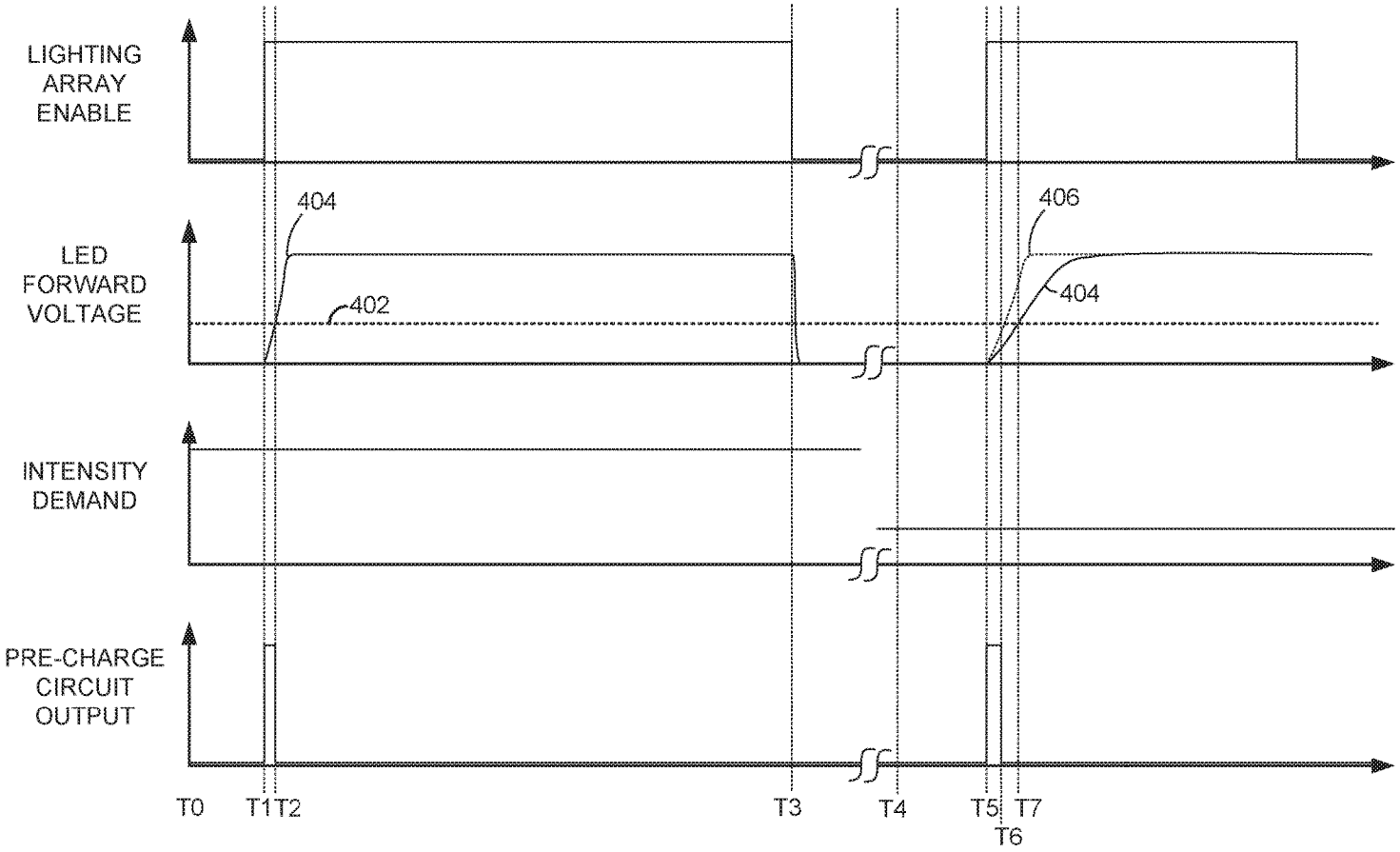
FIG. 4 shows example lighting array activation sequences.

Referring now to FIG. 4, example prophetic lighting array activation sequences are shown. FIG. 4 shows four plots that are time aligned and that occur at a same time. Vertical markers at times T0-T7 represent times of interest. The sequences of FIG. 4 may be provided by the system shown in FIGS. 1-3. Further, the sequence may be provided by the method of FIG. 5 as performed by the system of FIGS. 1-3. The SS indications along the horizontal axis represent brakes in time. The brakes in time may be of long or short duration.

The first plot from the top of FIG. 4 is a plot of a lighting array enable or activation request versus time. The lighting array activation request may be provided to the GENABLE input shown in FIG. 3. The vertical axis represents a voltage level of the lighting array enable signal and the voltage level increases from the horizontal axis in. The lighting array is requested to be enabled and activated when the trace is at a higher level. The lighting array is requested off and deactivated when the trace is at a lower level. The horizontal axis represents time and time increases from the left side of the figure to the right side of the figure.

The second plot from the top of FIG. 4 is a plot of a LED forward voltage or voltage at the anodes of the LEDs versus time. The vertical axis represents LED voltage and LED voltage increases in the direction of the vertical axis arrow. The horizontal axis represents time and time increases from the left side of the figure to the right side of the figure. The horizontal line 402 represents a threshold voltage above which the pre-charge circuit voltage pulse is truncated or cut-off and transitions to a value of zero volts. Solid line 404 represents LED forward voltage if the pre-charge circuit output voltage is not applied and the voltage regulator output is based on the lighting array intensity command. Dashed line 406 represents LED forward voltage if the pre-charge circuit output voltage is applied to the voltage regulator. The LED forward voltage if the pre-charge circuit output voltage is applied to the voltage regular is the same as the LED forward voltage if the pre-charge circuit output voltage is not applied to the voltage regulator when only solid line 404 is visible.

The third plot from the top of FIG. 4 is a plot of a lighting array intensity demand versus time. The vertical axis represents lighting array intensity demand and lighting array intensity demand increases in the direction of the vertical axis arrow. The horizontal axis represents time and time increases from the left side of the figure to the right side of the figure. The lighting array intensity demand may be made via a potentiometer (e.g., 218 shown in FIG. 2) or other device.

The fourth plot from the top of FIG. 4 is a plot of a pre-charge circuit voltage output (e.g., 365 of FIG. 3) versus time. The vertical axis represents pre-charge circuit voltage output and pre-charge circuit voltage output increases in the direction of the vertical axis arrow. The horizontal axis represents time and time increases from the left side of the figure to the right side of the figure.

At time T0, the lighting array is off as indicated by the lighting array enable trace not being asserted or not being at a higher level. The LED forward voltage is zero and the intensity demand is at a higher level. The pre-charge circuit output is zero.

At time T1, the lighting array is commanded on as indicated by the lighting array enable trace being asserted and at a higher level. The LED forward voltage begins to increase in response to the lighting array enable being asserted. The lighting array intensity demand remains at a higher level. The pre-charge circuit output transitions to a higher level in response to the lighting array enable being asserted.

At time T2, the lighting array remains activated as indicated by the lighting array enable trace being asserted and at a higher level. The LED forward voltage exceeds threshold 402 and the lighting array intensity demand remains at a higher level. The pre-charge circuit output voltage transitions to a lower level in response to the LED forward voltage exceeding threshold 402. The command to the voltage regulator 204 in FIG. 2 transitions to a value requested by the user via a potentiometer or other type of control so that the desired light intensity is output by the lighting array. Thus, if the requested lighting array intensity is a high level where voltage regulator output increases rapidly, the pre-charge circuit output voltage may be reduced in response to LED voltage. The pre-charge circuit output voltage may be reduced to zero before a predetermined amount of time passes such that the lighting intensity command may supersede the pre-charge circuit output voltage demand. Otherwise, the pre-charge circuit output voltage may be reduced in response to the predetermined amount of time expiring.

At time T3, the lighting array enable signal is transitioned to a lower level and the lighting array output is deactivated in response to a user or controller command. The LED forward voltage decreases in response to the lighting array being deactivated and the lighting array intensity demand remains at a higher level. The pre-charge circuit output voltage remains at a lower level.

At time T4, the lighting array is off as indicated by the lighting array enable trace not being asserted or not at a higher level. The LED forward voltage is zero and the intensity demand is at a lower level. The pre-charge circuit output is zero.

At time T5, the lighting array is commanded on as indicated by the lighting array enable trace being asserted and at a higher level. The pre-charge circuit output transitions to a higher level in response to the lighting array enable being asserted. The LED forward voltage when the pre-charge circuit output voltage is applied to the voltage regular 406 begins to increase at a faster rate. The LED forward voltage when the pre-charge circuit output voltage is not applied to the voltage regular 404 increases at a slower rate. The reduction in LED forward voltage may be related to the lighting intensity demand being at a lower level.

Between time T5 and time T6, the LED forward voltage when the pre-charge circuit output voltage is not applied to the voltage regular 404 increases at a rate that is lower than the LED forward voltage when the pre-charge circuit output voltage 404 is not applied to the voltage regular as shown between time T1 and time T2. The lower rate of change may be attributable to additional time to charge resistor/capacitor networks in the voltage regulator when a low level light intensity is commanded. However, the LED forward voltage with the pre-charge circuit output voltage applied to the voltage regular 406, increases at a faster rate than the LED forward voltage when the pre-charge circuit output voltage 404 is not applied to the voltage regular.

At time T6, the lighting array remains activated as indicated by the lighting array enable trace being asserted and at a higher level. The LED forward voltage when the pre-charge circuit output voltage is applied to the voltage regular does not exceed threshold 402, but a threshold amount of time has expired. The threshold amount of time is measured from beginning at time T5 to ending at time T6. Therefore, the pre-charge circuit output voltage is reduced to zero. Notice that the LED forward voltage when the pre-charge circuit output voltage is not applied finally exceeds threshold 402 at time T7. Such a LED forward voltage may result in lighting intensity that is less consistent. Thus, the pre-charge circuit output voltage may improve lighting system light intensity consistency when lower light intensity demands are requested of the lighting system. In this way, the pre-charge circuit output voltage may be reduced in response to the predetermined amount of time expiring.

Figure 5:
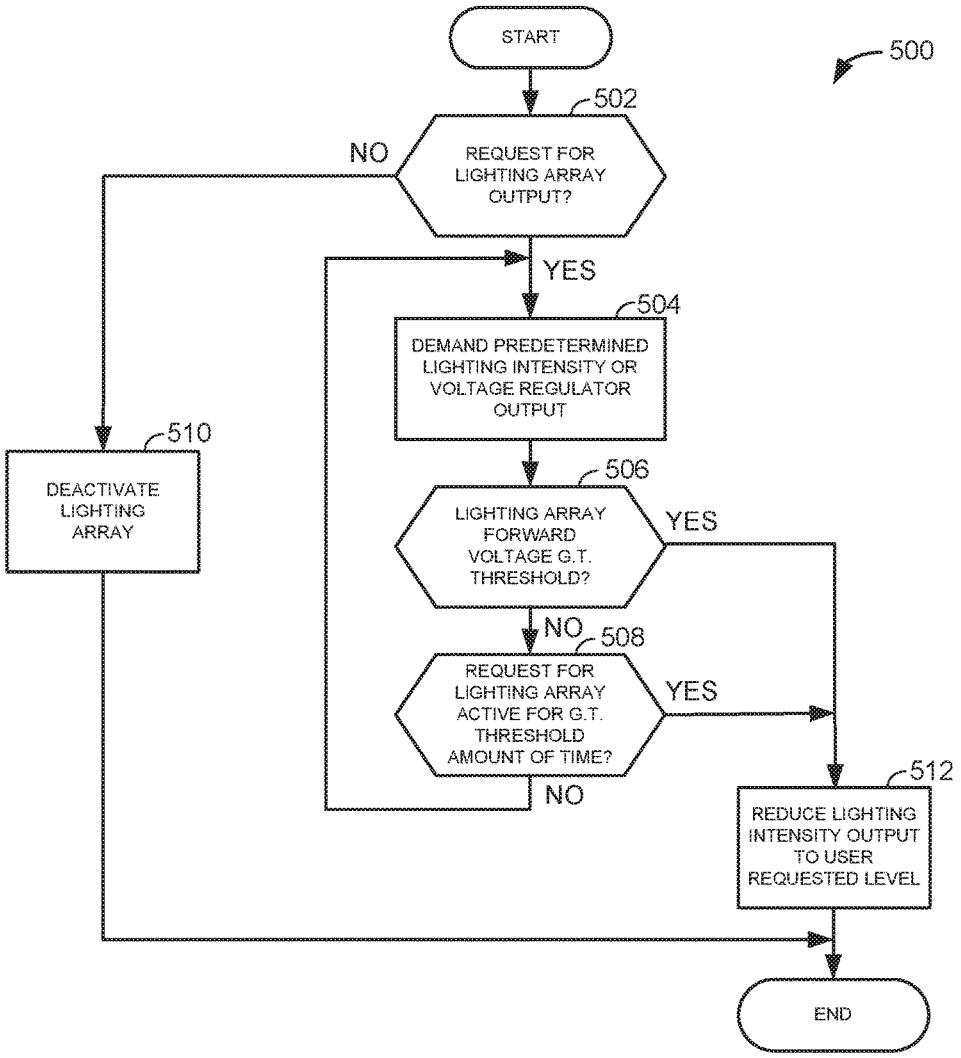
FIG. 5 shows an example method for controlling a photoreactive system.

Referring now to FIG. 5, a method for operating a lighting system is shown. The method may be performed via analog circuitry shown in FIGS. 1-3. Alternatively, the method may be performed via other circuitry that provides a similar function.

At 502, method 500 judges if there is a request for lighting array output (e.g., a request to illuminate an area or object). A request may be made via a human operator pressing a button, a controller, or via a switch being in a position that indicates lighting array output is requested. If method 500 judges that there is a request for lighting array output, the answer is yes and method 500 proceeds to 504. Otherwise, the answer is no and method 500 proceeds to 510.

At 510, method 500 deactivates the lighting array and shuts LEDs off. The LEDs may be shut off by commanding the voltage regulator to output zero volts and/or deactivating a power supply that supplies power to the LEDs. Method 500 proceeds to exit after deactivating the lighting array and turning off the LEDs.

At 504, method 500 demands a predetermined lighting intensity or voltage regulator output. The predetermined lighting intensity may be a value greater than 75% of full scale lighting intensity or rated voltage regulator output. In one example, the predetermined lighting intensity or voltage regulator output is commanded via a timing circuit as shown in FIG. 3. Further, the demand may be applied to the input of the voltage regulator. Method 500 proceeds to 506.

At 506, method 500 judges if the LED forward voltage of LEDs in the lighting array is greater than (G.T.) a threshold voltage. The forward voltage may be measured or determined via a voltage at the anodes of the LEDs in the lighting array. In one example, the judgement may be performed via an operational amplifier or a comparator as shown in FIG. 3. If the LED forward voltage is greater than the threshold voltage, the answer is yes and method 500 proceeds to 512. Otherwise, the answer is no and method 500 proceeds to 508.

At 508, method 500 judges if an amount of time that the demanded predetermined light intensity is applied to the voltage regulator is greater than a threshold amount of time. For example, method 400 judges if the voltage regulator has been commanded to a threshold level for more than a predetermined amount of time. Method 500 may make the judgement based on an amount of time a pulse width output of a timing circuit is greater than a threshold duration. In one example, the timer shown in FIG. 3 may make such determination and the predetermined amount of time may be based on selection of resistor and capacitance values. If method 500 judges that an amount of time the demanded predetermined light intensity from 504 has been requested for more than a predetermined amount of time, the answer is yes and method 500 proceeds to 512. Otherwise, the answer is no and method 500 returns to 504.

At 512, method 500 reduces the light intensity demand to a user requested level. The user requested level may be based on human input via a potentiometer or other control device. In one example, method 400 reduces the light intensity demand via transitioning a voltage pulse from a higher level to a lower level. Method 500 proceeds to exit.

Thus, the method of FIG. 5 provides for a method for operating one or more light emitting devices, comprising: supplying a voltage pulse to a voltage regulator input, a duration of the voltage pulse adjusted in response to a resistor and capacitor network and a voltage at one or more light emitting devices; and supplying electrical power to one or more light emitting devices via the voltage regulator. The method includes where the resistor and capacitor are electrically coupled to an analog timing circuit. The method includes where the voltage pulse is provided via an analog pre-charge circuit, and further comprising: supplying a voltage to the analog pre-charge circuit via a voltage divider, the voltage divider electrically coupled to the one or more light emitting devices. The method includes where the voltage pulse is output in only in response to a request to increase light intensity output of the one or more light emitting devices from zero to a threshold value. The method includes where the voltage of at the one or more light emitting devices is input to a comparator circuit. The method includes where the voltage pulse is provided via a pre-charge circuit, and where the pre-charge circuit includes a timer configured in a mono-stable mode.

As will be appreciated by one of ordinary skill in the art, the method described in FIG. 5 may be performed via the circuitry described herein. As such, various steps or functions illustrated may be performed in the sequence illustrated, in parallel, or in some cases omitted. Likewise, the order of processing is not necessarily required to achieve the objects, features, and advantages described herein, but is provided for ease of illustration and description. Although not explicitly illustrated, one of ordinary skill in the art will recognize that one or more of the illustrated steps or functions may be repeatedly performed depending on the particular circuitry being used.

This concludes the description. The reading of it by those skilled in the art would bring to mind many alterations and modifications without departing from the spirit and the scope of the description. For example, lighting sources producing different wavelengths of light may take advantage of the present description.

The invention claimed is:

1. A system for operating one or more light emitting devices, comprising:

an array of solid state lighting devices;

a voltage regulator including a voltage regulator input, the voltage regulator electrically coupled to the array of solid state lighting devices; and an analog pre-charge circuit having a pre-charge circuit output, the pre-charge circuit output electrically coupled to the voltage regulator input, the analog pre-charge circuit including an pre-charge circuit input, the pre-charge circuit input electrically coupled to the array of solid state lighting devices, the analog pre-charge circuit including a timing circuit, the analog pre-charge circuit including a first capacitor and a first resistor electrically coupled to the timing circuit.

2. The system of claim 1, further comprising a second resistor, a third resistor, and a second capacitor electrically coupled to the timing circuit.

3. The system of claim 1, further comprising a transistor electrically coupled to the second capacitor and the third resistor.

4. The system of claim 1, where the timing circuit including a TRIG bar input, a RESET bar input, a CONT bar input, a THRES input, a DISCH output, and an OUT output.

5. The system of claim 4, where first resistor and first capacitor are electrically coupled to the DISCH output, and where the DISCH output is electrically coupled to the THRES input.

6. The system of claim 4, where the second resistor and the second capacitor are electrically coupled to the TRIG bar input.

7. The system of claim 4, further comprising a third capacitor, where the third capacitor is electrically coupled to the CONT bar input.

8. The system of claim 4, where the OUT output is electrically coupled to an input of the voltage regulator.

9. A system for operating one or more light emitting devices, comprising:

an array of solid state lighting devices;

a voltage regulator including a voltage regulator input, the voltage regulator electrically coupled to the array of solid state lighting devices; and an analog pre-charge circuit having a pre-charge circuit output, the pre-charge circuit output electrically coupled to the voltage regulator input, the analog pre-charge circuit including a first pre-charge circuit input, the first pre-charge circuit input electrically coupled to the array of solid state lighting devices, the analog pre-charge circuit including a timing circuit, and the analog pre-charge circuit including a voltage comparator, the voltage comparator electrically coupled to the timing circuit and the first pre-charge circuit input.

10. The system of claim 9, further comprising a second pre-charge circuit input, the second pre-charge circuit input electrically coupled to a transistor.

11. The system of claim 10, where the transistor is electrically coupled to a third resistor and a second capacitor, and where the second capacitor is electrically coupled to a second resistor and a TRIG bar input of the timing circuit.

12. The system of claim 9, where the timing circuit including a TRIG bar input, a RESET bar input, a CONT bar input, a THRES input, a DISCH output, and an OUT output.

13. The system of claim 9, where the analog pre-charge circuit includes a first capacitor and a first resistor electrically coupled to the timing circuit.

14. The system of claim 9, further comprising a voltage divider electrically coupled to the voltage comparator.

15. A method for operating one or more light emitting devices, comprising:

supplying a voltage pulse to a voltage regulator input, a duration of the voltage pulse adjusted in response to a resistor and capacitor network and a voltage at one or more light emitting devices; and supplying electrical power to one or more light emitting devices via the voltage regulator.

16. The method of claim 15, where the resistor and capacitor are electrically coupled to an analog timing circuit.

17. The method of claim 15, where the voltage pulse is provided via an analog pre-charge circuit, and further comprising:

supplying a voltage to the analog pre-charge circuit via a voltage divider, the voltage divider electrically coupled to the one or more light emitting devices.

18. The method of claim 15, where the voltage pulse is output in only in response to a request to increase light intensity output of the one or more light emitting devices from zero to a threshold value.

19. The method of claim 15, where the voltage of at the one or more light emitting devices is input to a comparator circuit.

20. The method of claim 19, where the voltage pulse is provided via a pre-charge circuit, and where the pre-charge circuit includes a timer configured in a mono-stable mode.

* * * * *